US006139186A

United States Patent [19]

Fraser

[11] Patent Number: 6,139,186

[45] Date of Patent: Oct. 31, 2000

[54] BAG HAVING IMPROVED TIE FEATURES

[75] Inventor: Robert W. Fraser, Lombard, Ill.

[73] Assignee: First Brands Corporation, Oakland, Calif.

[21] Appl. No.: 09/168,046

[22] Filed: Oct. 7, 1998

[51] Int. Cl.[7] ..... B65D 33/16

[52] U.S. Cl. ..... 383/77; 383/17

[58] Field of Search ..... 383/77, 8, 17, 383/35

[56] References Cited

U.S. PATENT DOCUMENTS

| | | | |
|---|---|---|---|
| 4,125,220 | 11/1978 | Suominen | 383/37 X |
| 4,597,749 | 7/1986 | O'Brien et al. | 383/8 X |
| 4,709,400 | 11/1987 | Bruno | 383/77 |
| 4,890,736 | 1/1990 | Greyvenstein | 383/77 X |
| 5,041,317 | 8/1991 | Greyvenstein | 383/37 X |
| 5,246,110 | 9/1993 | Greyvenstein | 383/77 X |
| 5,611,627 | 3/1997 | Belias et al. | 383/77 X |
| 5,709,641 | 1/1998 | Vaquero | 493/243 |

FOREIGN PATENT DOCUMENTS

| | | | |
|---|---|---|---|
| 7181 | 1/1980 | European Pat. Off. | 383/17 |
| 1222974 | 2/1971 | United Kingdom | 383/8 |

*Primary Examiner*—Jes F. Pascua
*Attorney, Agent, or Firm*—Michael J. Bradley

[57] ABSTRACT

A tie bag having improved tie features is provided by increasing the thickness of the tie features as compared to the bag thickness.

14 Claims, 3 Drawing Sheets

BAG HAVING IMPROVED TIE FEATURES

FIELD OF THE INVENTION

The present invention pertains to tie bags used most commonly for the storage and disposal of debris and other ubiquitous waste materials and, more particularly, to bags having tie features having increased thickness as compared to the thickness of the remainder of the bag. This increase in the thickness of the tie features provides ease of handling, improved strength and improved ease of tying.

BACKGROUND OF THE INVENTION

The manufacture and use of polyethylene storage and disposal bags is well known in the art. One of the bothersome problems with the use of plain rectangularity shaped storage bags is the inconvenience involved in trying to tie the bag closed. Several brands use separate metal wire ties, which are packaged along with the bags. As a separate item, these metal wire ties can be unwieldy to use and often become lost.

A convenient user feature of the polyethylene bags of this invention are its tie features, which are integral with the body of the bag. These tie features comprise a curved, cut-out portion of the bag web. As built-in features, the ties can be grasped and knotted to seal the bag; hence, they are referred to in the trade as "tie bags". Representatives of such "tie bags" are those illustrated in U.S. Pat. Nos. 4,890,736, 5,041,317, 5,246,110, 5,683,340, 5,611,627 and 5,709,641, incorporated herein by reference thereto, which are characterized as having 2, 3 or 4 tie features.

These tie bags are characterized by having tie features that extend above the bag volume portion that is used for holding the bag contents. The tie features are used as closure means by tying the mouth of the bag closed after the contents of the bag have been placed in the bag.

It has been determined that the ease of tying and the strength of the joined tie features can be improved by making the plastic film thickness greater in the tie features as compared to the film thickness used for holding the contents portion of the bag.

The instant invention relates to a tie bag comprising two opposing sidewalls sealed along three of the four edges and having at least two tie features extending from said open edge of the sidewalls and characterized as being suitable for tying. The tie features are characterized as having a thickness greater than the thickness of the sidewalls of the bags. The relative thickness of the tie features will be discussed hereinafter.

SUMMARY OF THE INVENTION

In accordance with the present invention, there are provided a bag formed from two opposing side walls having four edges and sealed along three of the four edges and having at least two tie features extending from said fourth unsealed open edge of the side wall. The tie features are characterized as being suitable for tying and having a thickness greater than the thickness of the sidewalls. These tie features can comprise curved or other geometrically shaped portions of the bag film. The tie features can be grasped and knotted to seal the bag; hence, they are referred to in the trade as "tie bags". Representative tie bags which may be improved by using thickened tie features include, but are not limited to those disclosed in U.S. Pat. Nos. 4,890,736, 5,041,317, 5,246,110, 5,683,340, 5,611,627 and 5,709,641, said patents being incorporated herein by reference thereto.

The instant tie bags are characterized by having tie features that extend above the bag volume portion of the bag used for holding the bag contents. The tie features are used as closure means for tying the mouth of the bag closed after the contents of the bag have been placed into the bag. After the tie features are joined the joined tie features can be used as a handle to lift the bag to transport the bag from one location to another location.

It is an object of the present invention to provide a bag having increased thickness in the tie features to improve the use of the bag.

It is another object of the invention to provide a method for manufacturing a tie bag where a film can be produced to have increased thickness in the tie features.

BRIEF DESCRIPTION OF THE DRAWINGS

A complete understanding of the present invention may be obtained by reference to the accompanying drawings, when considered in conjunction with the subsequent detail description, in which.

For the purposes of clarity and brevity, like elements and components will bear the same designation throughout the figures.

DESCRIPTION OF THE INVENTION

Generally speaking, the bag having tie features can be made in a single bag process but is preferably made by a continuous process in which the bags are manufactured from a continuous double web or tube of a polyethylene or other thermoplastic film. The open end of the thermoplastic film to serve as the mouth of the bag may be cut in a geometric pattern, such as a serpentine or sinusoidal pattern, to provide the tie features. The tie features may be extended as they move along the conveyor or may be folded inwardly or outwardly if desired. Thereafter, in subsequent operations, the continuous web of thermoplastic film is sized, cut into individual bag units, stacked and packaged.

Generally speaking, the tie bags can be formed from a web of flexible, plastic material that is to be sized and cut into individual bags having geometrically-shaped tie feature for each bag unit. The geometric shape can be arc shaped, e.g., such may be formed as a sinusoidal cut along the mouth of the film forming the mouth of the bag. The tie features can be cut in sinusoidal shapes and can be overlapping or in a skewed not overlapping arrangement of the individual bag units as shown in U.S. Pat. Nos. 4,890,736, 5,041,317, 5,246,110, 5,683,340, 5,611,627 and 5,709,641, incorporated herein by referenced thereto. These tie features can be formed by forming a curved, cut-out portion of the bag web. The tie features can be grasped and knotted to seal the bag, such as the tie features shown in the tie bags illustrated in U.S. Pat. Nos. 4,890,736, 5,041,317, 5,246,110, 5,683,340, 5,611,627 and 5,709,641.

Figure 1:
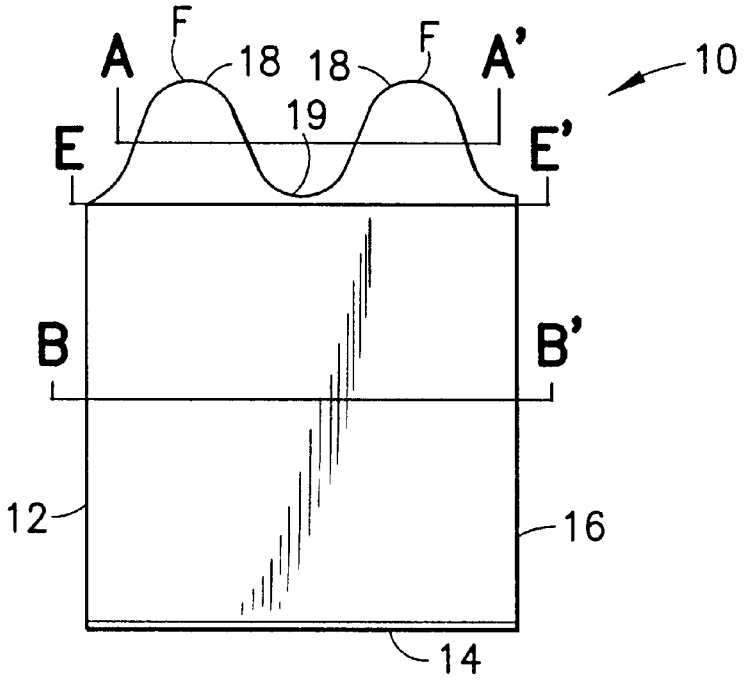
FIG. 1 illustrates a perspective view of a bag film having two tie features on one sidewall showing line A–A' in tie features having increased thickness over the area along line B–B' in the bag body.

Referring to FIG. 1, a tie bag 10 is shown formed of two sidewalls connected at three edges 12, 14 and 16 of the generally rectangular sidewalls and open at the fourth edge with tie features 18. The sidewalls can be connected by sealing or one or more edges may be a fold in a length of film. The tie features extend from the fourth open edge and are shown as integral with the sidewalls of the tie bag. FIG. 1 shows a tie bag 10 having four tie features as shown in FIG. 1 of U.S. Pat. No. 5,246,100, with each sidewall having 2 tie features. Alternatively, the tie bag can have two, three or four tie features as disclosed in U.S. Pat. Nos. 5,246,110 and 5,611,627. Although there are several processes by which the tie bags can be made to have tie features with a greater thickness than the bag film used to form the body of the bag, each tie bag will comprise a bag having tie features having an average film thickness greater than the average film thickness of the film used to form the major portion of the bag body. Referring to FIG. 1, the thickness of the tie feature along line A–A' will be greater than the thickness along line B–B' in the bag body. As discussed hereinafter, the tie features along line A–A' will have a film thickness that is preferably greater than 1.1:1 to about 3:1 the thickness of the bag body along B–B'. The average thickness of the sidewalls and the average thickness of the tie features can be best understood by reference to FIG. 1. As noted above, the tie features will have a thickness greater than the thickness of the sidewalls. This greater thickness can be achieved by modification of the film extrusion method and by coextrusion of a plastic material in the area of the tie feature. The tie feature in FIG. 1 is the bag area above line E–E' which forms tie features 18 and extend from line E–E' to the tie feature end at F. The bag body and sidewalls forming the bag body extend from line E–E' to bottom edge 14. Line B–B' in FIG. 1 is shown equidistant between line E–E' and bottom edge.

In one embodiment the tie features are formed from a film having a gradual thickening in the film in the film area which forms the open mouth of the bag at A–A' up to about 1.25 mil from the film thickness that forms the portion that forms the bag body at B–B' of about 0.85 mil. Owing to the cost of plastic materials used to manufacture tie bags and the desired improvement in bag properties, the tie features will typically have an average thickness as compared to the thickness of the bag body thickness of from greater than 1.1:1 to about 2:1 and preferably from greater than 1.1:1 to about 1.5:1. In another embodiment the bag body adjacent the mouth of the bag will be gradually increasing in thickness as it nears the mouth of the bag as the film forms the tie features. This gradual thickening in the bag film may be beneficial both in manufacturing and in the benefit it provides in gradually distributing the load forces in the bag when the tie features are tied and then used as a lifting handle for a filled bag.

Figure 2:
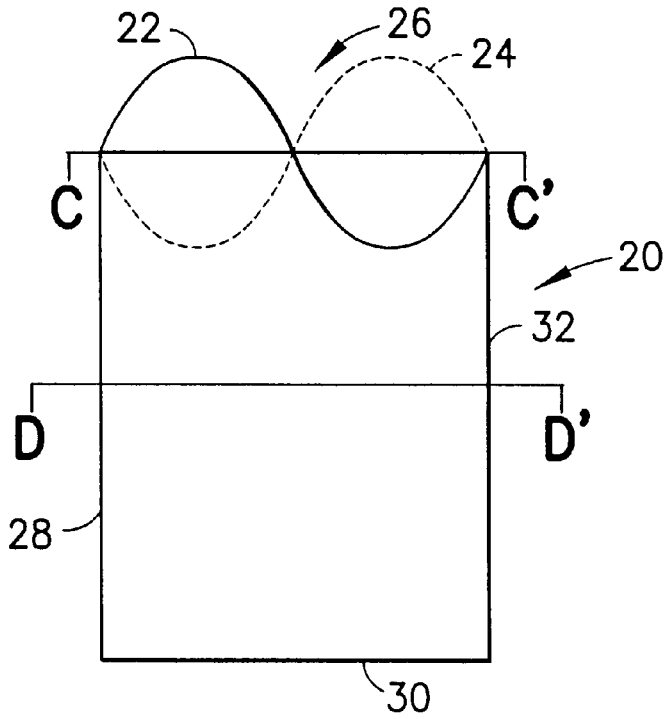
FIG. 2 depicts a perspective view of a web showing the relative thickness of the bag film and two features of the bag along C–C' and along line D–D' of the bag body.

FIG. 2 shows an easy open thermoplastic tie bag 20 of the type disclosed in U.S. Pat. No. 5,611,627. FIG. 2 shows a bag where two tie features 22 and 24 do not overlap at the mouth of the bag 26 and three sides 28, 30 and 32 are sealed. The thickness of the non-overlapping tie features is greater at line C–C' as compared to the thickness of the bag body along line D–D', in the same manner as discussed above for the tie bag shown in FIG. 1. Owing to the cost of plastic materials used to manufacture tie bags and the desired improvement in bag properties, the tie features will typically have an average thickness as compared to the thickness of the bag body of from about 1.1:1 to about 3:1, as disclosed above.

The bags shown in FIG. 2 are disclosed in U.S. Pat. Nos. 5,611,627, 5,683,340 and 5,709,641 and may be manufactured in keeping with the instant invention to provide a thermoplastic comprising a first layer and a second layer, said first and second layers joined along a pair of opposing sides and a bottom bridging said sides so as to form an open mouth, said first and second layers including respective leading edges opposing said bottom and bridging said sides, said leading edges of said respective layers being profiled such that when the bag is in lay flat condition, at least one tie portion of said first layer does not overlap with said second layer and at least one tie portion of said second layer does not overlap with said first layer, said leading edges of said respective layers including respective linear regions located near said opposing sides and oriented generally perpendicular to said opposing sides, said first and second layers being in continuously overlapping relationship along said linear regions, said opposing sides including a heat seal line generally parallel to each of the opposing sides, said heat seal lines extending along the entire length of the sides and terminating at a point within the linear regions of the leading edges of said bags. The opposing sides may further include perforated line extending along the sides of the bags for separating them from said continuous roll of the bags.

The tie bags may be sized and cut into individual bag units from a moving film web utilizing a hot knife or other film web severing means. The individual bag units may then individually fed to a folding apparatus. Alternatively, the web can be perforated in the seal between bags and formed into a roll of bags.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

In accordance with the instant invention a new variable in tie bag construction is provided. The bag variables are illustrated by the embodiments described in Table I below. Table I gives desirable film thickness in various portions of the bag film for bags of 30 gallon capacity that have 4 sinusoidal shaped tie features. The bags were formed by blown film extrusion with a gradual thickening of the tie features from the thickness of the bag film. Bag length is defined as the dimension from the bottom of the bag to the lowest point of the tie feature. The typical height of the tie feature is measured as the dimension from the bottom of the tie feature at E–E' to the top of the tie feature at F.

TABLE I

| Bag Feature | Thickness in Mils |
|---|---|
| Tie feature thickness | 1.0 to 1.30 |
| Bag body thickness | 0.75 to 0.85 |
| Tie feature height | 5 inches |
| Tie feature width at base | 15 inches |

Figure 3:
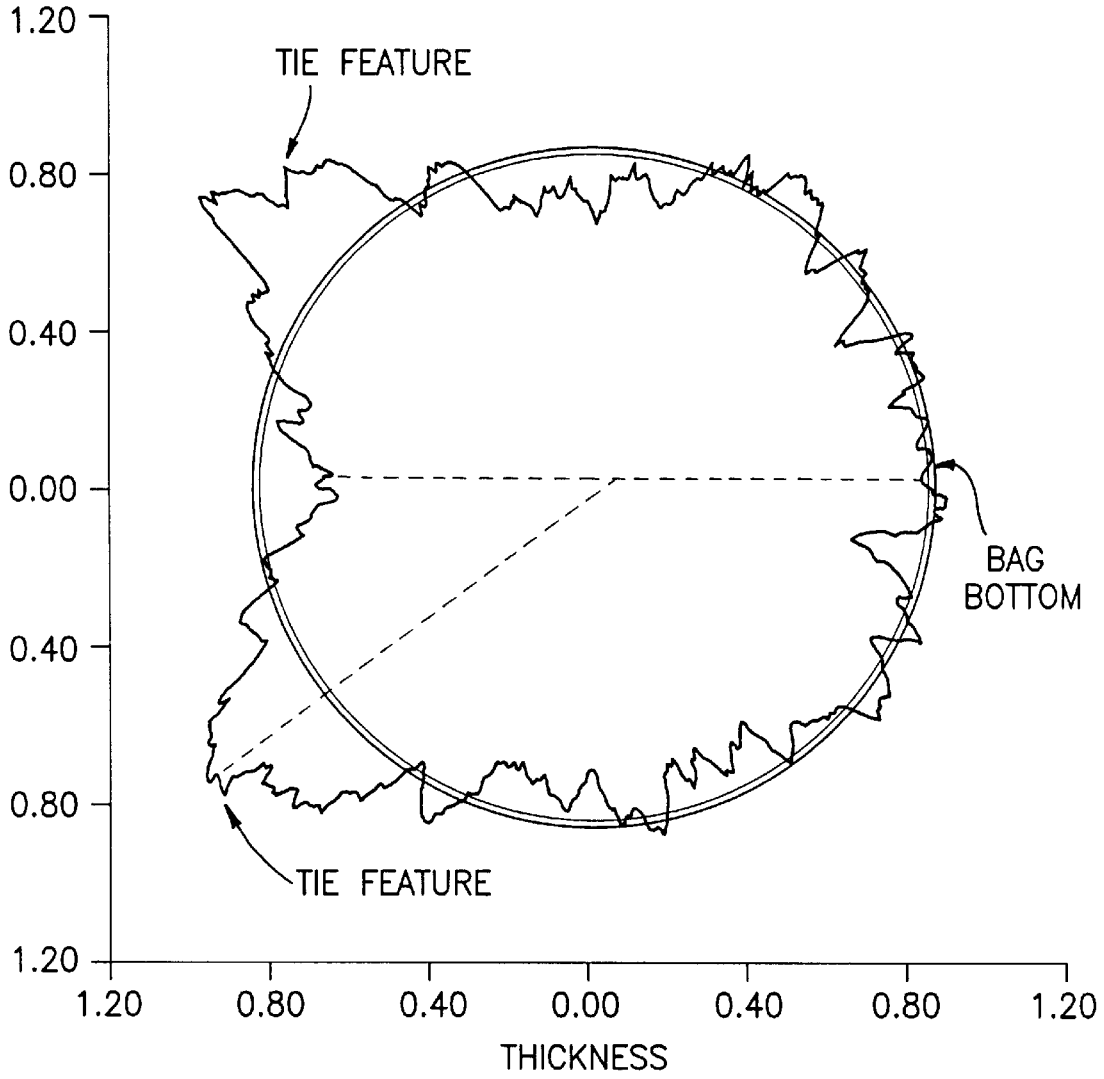
FIG. 3 shows a thickness profile of a blown film sidewall having a gradual change in thickness from the body of the bag to the two tie features at the mouth of the bag.

The instant invention provides tie bags having tie features with increased thickness and may be formed from a film formed by blown film extrusion with increased air cooling in the annular air ring where the tie features are formed as the film is extruded as a blow tubular film. The increased cooling in the blown film can be created by profiling the annular air ring opening at the areas where the tie features would be located in the blown film by increasing the opening of the air cooling ring in these area to give increased cooling at the blown film tube where increased thickness of the film was desired, i.e. the film area where the tie features were to be formed. By changing the annular air ring opening in this manner the average thickness of a bag body can be varied from about 0.85 mils to an increased thickness for the tie features of as much as 1.25 mil or greater. FIG. 3 shows a polar plot of the film thickness of a blown film formed in this manner showing a film thickness at the bottom of the bag body of about 0.80 mils and having a thickness in the tie feature of up to about 1.1 mils. The film thickness was measured with a Measuretech Series 200 thickness gauge available from Measurement Technology Corporation. As shown in FIG. 3, the thickness from the bag body to the tie features gradually thickens, since the blown film extrusion process is a continuous process. As the air cooling is applied during the blown film extrusion process the cooling is applied across a moving surface and the increased cooling causes a thickening of the plastic film in the area at and adjacent to the tie features.

Depending on the number of tie features selected, the tie feature length may be varied from about 4 inches to about 6 inches. When a tie bag has four tie features the tie feature length is typically about 4 to 5 inches for a 30 gallon bag sizes so as to provide sufficient length to easily grasp the tie feature for tying. For such a tie feature the width of the sinusoidal shaped tie feature would typically be about 15 inches if 4 tie features are used at the mouth of the bag. However, these lengths and widths for the tie features are intended as non-limiting examples only. As will be well appreciated by a person of ordinary skill in the art, member length and width may be adjusted as needed for a particular application, the number of tie features and selected use of the bag.

Figure 4:
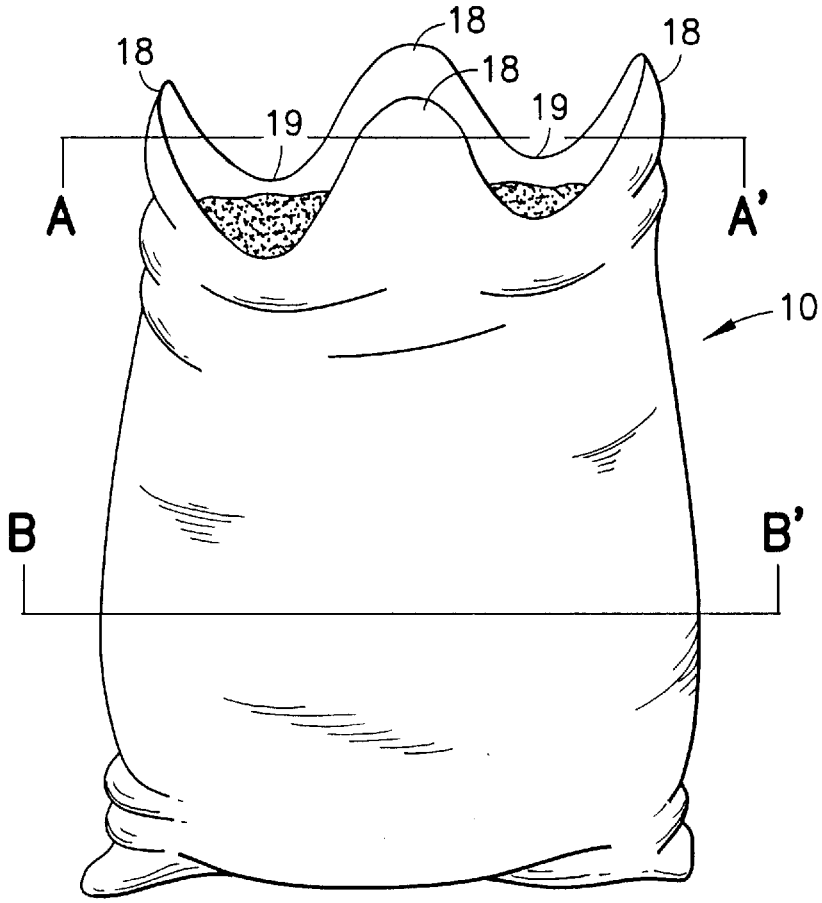
FIG. 4 shows a bag having four tie features in a filled, untied embodiment.

The increased thickness of the tie feature permits the user to open the bag by grasping the tie features more easily owing to the increased thickness of the tie features extending above the body of the bag. The tie features may be integral extensions of the two bag sidewalls and their separation opens the bag. Pulling apart the thickened tie features also more easily permits separation of even thin thermoplastic film materials. After loading the bag, the tie features are pulled toward each other to close the open mouth of the bag after filling and are then tied together to effect closure of the bag. The thicker tie features can provide a stronger handle when tied. A closed bag is illustrated in FIG. 4. An advantage of bags having tie features over rectangularly shaped bags without tie features is that a strong carrying feature is created by joining the tie features, making it easy for loaded bags to be picked up and transported. Further, the user need tie only a single pair of members to close the bag or may tie two pair of tie features, depending on the selected number of tie features.

The tie bag 10 shown in FIG. 1 is shown in a filled configuration in FIG. 4 with four tie features 18 with cut-out portion 19 between two tie features 18 along line A–A' is greater than the thickness of the bag body long line B–B'. The tie bag 10 shown filled in FIG. 4 is shown tied in FIG. 5 with the four tie features 18 cross tied to form a handle by which the tie bag can be lifted and through its formation acts to close the mouth of the bag.

Figure 5:
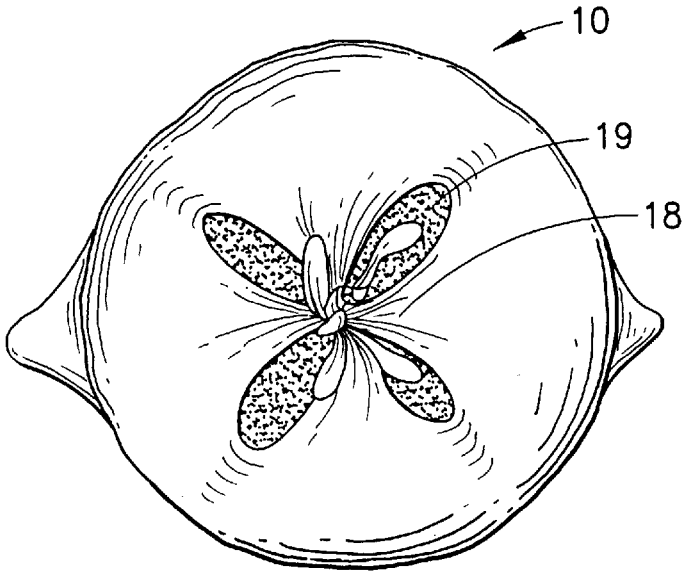
FIG. 5 shows a bag having four tie features in a filled, tied embodiment.

The thickness of the tie features is along line A–A' of FIG. 1 is greater than the thickness of the bag body as shown along line B–B' of Figure. Depending on the method of forming the film from which the bag is manufactured the transition in thickness from along line B–B' to the greater thickness along line A–A' can be gradual or can be sudden. If the film is manufactured by a blown film extrusion with the film being formed by differential annular cooling during the blown film production the thickness of the film at B–B' may be a gradual thickening to a point of greater thickness at A–A' shown in FIG. 1. In a plastic bag formed of a film having a thickness of from about 0.8 mil to about 1.0 mil the along B–B' the thickness along line A–A' would typically be from 30 percent to about 60 percent thicker. For example if the film thickness along B–B' is 0.8 mil the thickness along A–A' may be 1.2 mils in thick. The bag is preferably made as extrusion such that the change in thickness from B–B' is gradual to the increased thickness at A–A'. It is believed that this gradual change in thickness within the film provides improved strength in the tie feature and provides improved load distribution during the lifting of the filled bag by the tied tie features, as shown in FIG. 5. In another embodiment the tie feature can be made thicker by reinforcing the tie feature by adding another layer of plastic by coextrusion or other means so that the tie features have a greater thickness than the remainder of the bag. In another embodiment the film may be formed by slot or other extrusions so that the film can be extruded using two different thermoplastic materials either as separate streams or be coextruding a second material on top of a first material. For example a first polyethylene material can be formed into a film and a second material of a stronger thermoplastic material extruded adjacent to and connected thereto or extruded as a second layer of a single on variable thickness on the first material. For example, the first layer may be a linear low-density polyethylene and the second layer may be a ultra-low density polyethylene having greater tear resistance. In this manner the tie feature can be formed from the thermoplastic material having the better resistance to tearing. Similarly, the tie feature can be formed of a selected material that has a desired property which benefits the use of the tie feature as a bag carrying feature, such as improved tying, improved handleability, improved strength or improved stiffness if the material forming the tie feature is formed from a blend of HDPE and LLDPE. The use of such resin blends provide tie features that can exhibit improved strength when used as a handle when the tie features are tied.

The invention is not limited to the precise constructional details hereinbefore described an illustrated. For example the bags may have more or fewer projections and cut-outs so long as at least two of the features are employed. The shape of the projections and cut-outs may vary as desired. The tie features are preferably shapes with rounded comers but they may be zig-zag or rectangular in shape preferably with suitable means being provided to prevent tearing at the corners adjacent to the bag body. The bags may be formed in pairs joined at perforation cuts at either the open or the closed end. The bags may also be used for other storage transport purposes such as carrier bags. The bags may be gussetted if desired even though this will typically reduce the capacity of the bag.

The currently preferred plastics materials for plastic bags are the various forms of polyethylene, including high density and the various forms of low density polyethylene, polypropylene and blend of these and other plastic material capable of being formed into films having a thickness of between about 0.5 mil and 3 mil. Any thermoplastic material suitable for use in making films may be used to make the present invention. Preferred materials include the family of polyethylenes to include high density and numerous low-density polyethylenes and metallocene polyethylene resins. Particularly preferred is linear low-density polyethylene (LLDPE). LLDPE is an ethylenic copolymer formed by copolymerizing ethylene with a minor proportion by weight of an alpha-olefin monomer containing 4 to 10 carbon atoms. The use of LLDPE in garbage bags has permitted manufacturers to increase strength, puncture resistance and tear resistance properties. By way of example not intended to limit the scope of the present invention, typical film thickness used for bags of the present invention is from about 0.3 mil to about 1.5 mil.

Forming members in wave-like fashion as described herein is advantageous in continuous manufacturing. In addition to the features already described, member reinforcements may be employed according to the method disclosed in U.S. Pat. Nos. 4,125,220, 4,890,736, 5,041,317, 5,246,110, 5,683,340, 5,611,627 and 5,709,641; the contents of which are incorporated herein by reference.

Although the present invention has been described with preferred embodiments, it is to be understood that modifications and variations may be utilized without departing from the spirit and scope of this invention, as those skilled in the art will readily understand. Such modifications and variations are considered to be within the purview and scope of the appended claims.

What is claimed is:

1. A tie bag comprising two opposing side walls having four peripheral edges and sealed along three of said four peripheral edges sides with said fourth edge being open, said opposing sidewalls gradually increasing in thickness as it nears said open peripheral edge, and having at least two integral tie features extending from said open peripheral edge and characterized as being suitable for tying wherein said integral tie features have an average thickness greater than the thickness of the sidewalls.

2. A tie bag according to claim 1 wherein the thickness of the tie features is between 1.1:1 and about 3:1 the thickness of the sidewalls.

3. A tie bag according to claim 1 wherein said tie features have a varying thickness, which has an average thickness over its length greater than the average thickness of said sidewalls.

4. A tie bag according to claim 1 where in the sidewalls have an average thickness of about 0.75 to 0.85 mil and the tie features have an average thickness of greater than 1.1 mil.

5. A tie bag according to claim 1 where in the ratio of average thickness of the tie features to the average thickness of the sidewalls is between about 1.1:1 and about 3:1.

6. A tie bag according to claim 5 where the ratio of the average thickness of the tie features to the average thickness of the sidewalls is between about 1.1:1 and about 2:1.

7. A tie bag according to claim 1 where in said tie features are wave-shaped.

8. A tie bag according to claim 7 wherein said tie features are substantially sinusoidially shaped.

9. A tie bag according to claim 8 wherein said bag has two tie features having sinusoidal shapes and said ties are skewed along the open edges and to not overlap with respect to each other.

10. A tie bag according to claim 1 wherein said tie bag is formed of two film materials wherein said tie feature is formed with a second film different from the film in said sidewalls.

11. A tie bag according to claim 10 wherein said tie feature is formed of a film material having a greater strength than said material forming the sidewalls.

12. A bag according to claim 1 comprising first layer and a second layer, said first and second layers joined along a pair of opposing sides and a bottom bridging said sides so as to form an open mouth, said first and second layers including respective leading edges opposing said bottom and bridging said sides, said leading edges of said respective layers being profiled such that when the bag is in lay flat condition, at least one tie portion of said first layer does not overlap with said second layer and at least one tie portion of said second layer does not overlap with said first layer, said leading edges of said respective layers including respective linear regions located near said opposing sides and oriented generally perpendicular to said opposing sides, said first and second layers being in continuously overlapping relationship along said linear regions, said opposing sides including a heat seal line generally parallel to each of the opposing sides, said heat seal lines extending along the entire length of the sides and terminating at a point within the linear regions of the leading edges of said bags.

13. A tie comprising two opposing walls having four peripheral edges and being closed along three of said four peripheral edges with said fourth edge being open, each of said opposing sidewalls gradually increasing in thickness near said open peripheral edge, and having at least two integral tie features extending from said open peripheral edge and characterized as being suitable for tying, wherein said integral tie features have an average thickness greater than the thickness of said sidewalls.

14. A tie bag according to claim 13 wherein one of said three closed peripheral edges comprises a fold adjoining said sidewalls.

* * * * *